US007337827B2

(12) United States Patent
Marti et al.

(10) Patent No.: US 7,337,827 B2
(45) Date of Patent: Mar. 4, 2008

(54) METHOD FOR OPERATING A STRIP CASTING MACHINE FOR PRODUCING A METAL STRIP

(75) Inventors: Heinrich Marti, Forch (CH); Jacques Barbé, Tarantaise (FR); Hans Streubel, Erkrath (DE)

(73) Assignees: SMS Demag AG, Duesseldorf (DE); Main Management Inspiration AG, Hergiswil (CH)

( * ) Notice: Subject to any disclaimer, the term of this patent is extended or adjusted under 35 U.S.C. 154(b) by 0 days.

(21) Appl. No.: 10/563,543

(22) PCT Filed: Jun. 25, 2004

(86) PCT No.: PCT/EP2004/006884

§ 371 (c)(1),
(2), (4) Date: May 17, 2006

(87) PCT Pub. No.: WO2005/002757

PCT Pub. Date: Jan. 13, 2005

(65) Prior Publication Data

US 2007/0006990 A1 Jan. 11, 2007

(30) Foreign Application Priority Data

Jul. 1, 2003 (CH) ..... 1161/03

(51) Int. Cl.
*B22D 11/06* (2006.01)

(52) U.S. Cl. ..... 164/480; 164/428

(58) Field of Classification Search ..... 164/480, 164/428

See application file for complete search history.

(56) References Cited

U.S. PATENT DOCUMENTS

| | | | | |
|---|---|---|---|---|
| 5,201,362 | A * | 4/1993 | Yamagami et al. | 164/480 |
| 5,584,335 | A * | 12/1996 | Barbe et al. | 164/428 |
| 6,032,722 | A * | 3/2000 | Russell et al. | 164/428 |
| 6,296,046 | B1 | 10/2001 | Jeong et al. | |

FOREIGN PATENT DOCUMENTS

| | | |
|---|---|---|
| EP | 0546206 | 6/1993 |
| EP | 0677345 | 3/1994 |
| WO | WO0123121 A1 | 4/2001 |
| WO | WO0123122 A1 | 4/2001 |
| WO | 4000487 | 12/2003 |

* cited by examiner

*Primary Examiner*—Kuang Lin
(74) *Attorney, Agent, or Firm*—Abelman, Frayne & Schwab

(57) ABSTRACT

The invention relates to a method of operating a strip casting machine for producing a metal strip, during which molten metal is continuously poured between two casting rolls (1, 2) that form a casting gap. Lateral seals (10) having sealing plates (11) are provided for laterally delimiting the casting gap, whereby the sealing plates (11) are placed or pressed with a preset placement or pressing force, whose magnitude can be set, against the end surfaces of the casting rolls (1, 2). The sealing plates (11) are, in repeatable stop-and-go steps, placed with a preset force and time against the end surfaces of the casting rolls (1, 2) and are held in the placing position for a preset time. This enables a distinct reduction in the wear of the sealing plates and of the casting roll end surfaces.

20 Claims, 2 Drawing Sheets

METHOD FOR OPERATING A STRIP CASTING MACHINE FOR PRODUCING A METAL STRIP

CROSS-REFERENCE TO RELATED APPLICATIONS

This application is a 371 of international application number PCT/EP2004/006884, filed on Jun. 25, 2004.

BACKGROUND OF THE INVENTION

1. Field of the Invention

The invention relates to a method of operating a strip casting machine for producing a metal strip.

2. Description of the Related Art

From, e.g., WO-A-01/23122 it is known to place or to press, with a predetermined force, lateral seals, which are provided with sealing plates, against end surfaces of casting rolls during an entire duration of a casting operation for limiting a casting gap between the casting rolls in order to insure the necessary tightness. A monitoring and regulating system provides for a precise bearing of the sealing plates against the end surfaces of the casting rolls and for a continuous regulation of the placement pressure. Known strip casting machines operate by which lateral seals, in addition, are displaced in a horizontal or vertical direction or oscillate to prevent a non-uniform wear of the sealing plates. However, with this type of the sealing plate adjustment a high wear of both the sealing plates and the roll end surfaces cannot be prevented, which limit the casting time and increases the costs of the process because of high costs of the sealing plates and big output losses.

BRIEF SUMMARY OF THE INVENTION

An object of the invention is to provide a process of the type described above which would permit a noticeable wear reduction.

According to the invention, this object is achieved with a process having features of operating a strip casting machine produces a metal strip, during which molten metal is continuously poured between two casting rolls that form a casting gap. Lateral seals having sealing plates laterally delimit the casting gap, in which the sealing plates are placed or pressed with a preset placement or pressing force against the end surfaces of the casting rolls. The magnitude of the placement or pressing force can be set. The sealing plates are placed by repeated intermittent steps with a preset force and time against the end surfaces of the casting rolls and are held in the placing position for a preset time. This enables a distinct reduction in the wear of the sealing plates and of the casting roll end surfaces.

Further advantageous embodiments of the inventive process are defined by the subject matter of dependent claims.

With the inventive method, according to which the sealing plates are placed in repeatable intermittent steps with a predetermined force and within a predetermined time against the end surfaces of the casting rolls, and are held in the stop position for a predetermined time, the wear of the sealing plates and the end surfaces of the casting rolls is noticeably reduced.

Advantageously, the placement force of the sealing plates against the end surfaces of the casting rolls and/or holding time of the sealing plate in the applied position is varied, whereby the method can be adapted to specific casting characteristics.

Advantageously, the holding time is greater than the placement time at least in two times and at most in three hundred times. A longer operating time, which results from a smaller wear, leads to noticeably smaller costs of the sealing plates per ton of steel, to longer casting sequences, and to a higher output, whereby the economy of the process is substantially improved.

BRIEF DESCRIPTION OF THE SEVERAL VIEWS OF THE DRAWINGS

The invention will be described in detail below with reference to the drawings.

The drawings show.

DETAILED DESCRIPTION OF THE INVENTION

The present invention is related to international application number PCT/EP2004/006884, filed on Jun. 25, 2004, which is incorporated herein by reference in its entirety.

Figure 1:
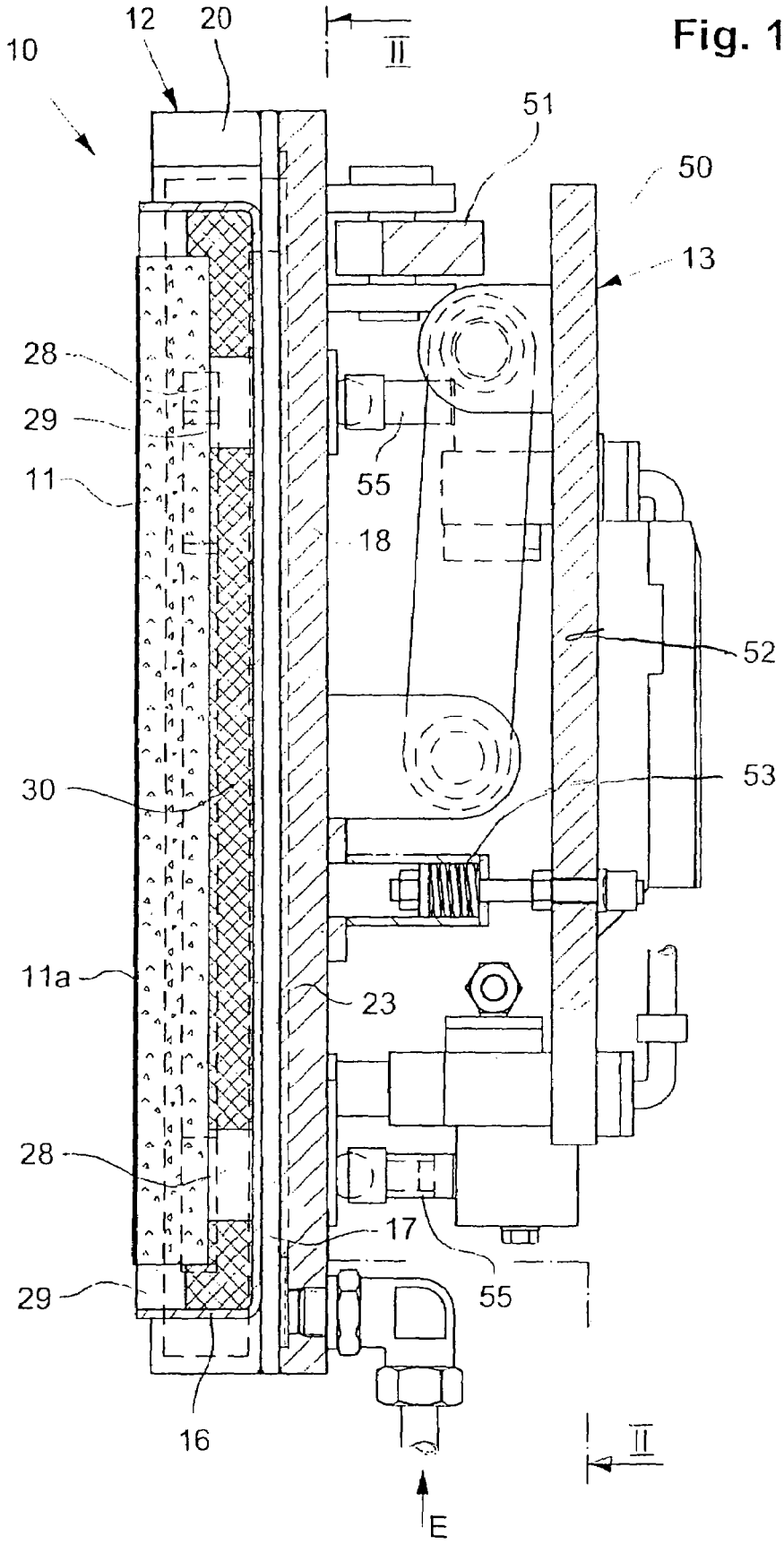
FIG. 1 a vertical longitudinal cross-sectional view of an embodiment of a lateral seal with a sealing plate for a strip casting machine.
Figure 2:
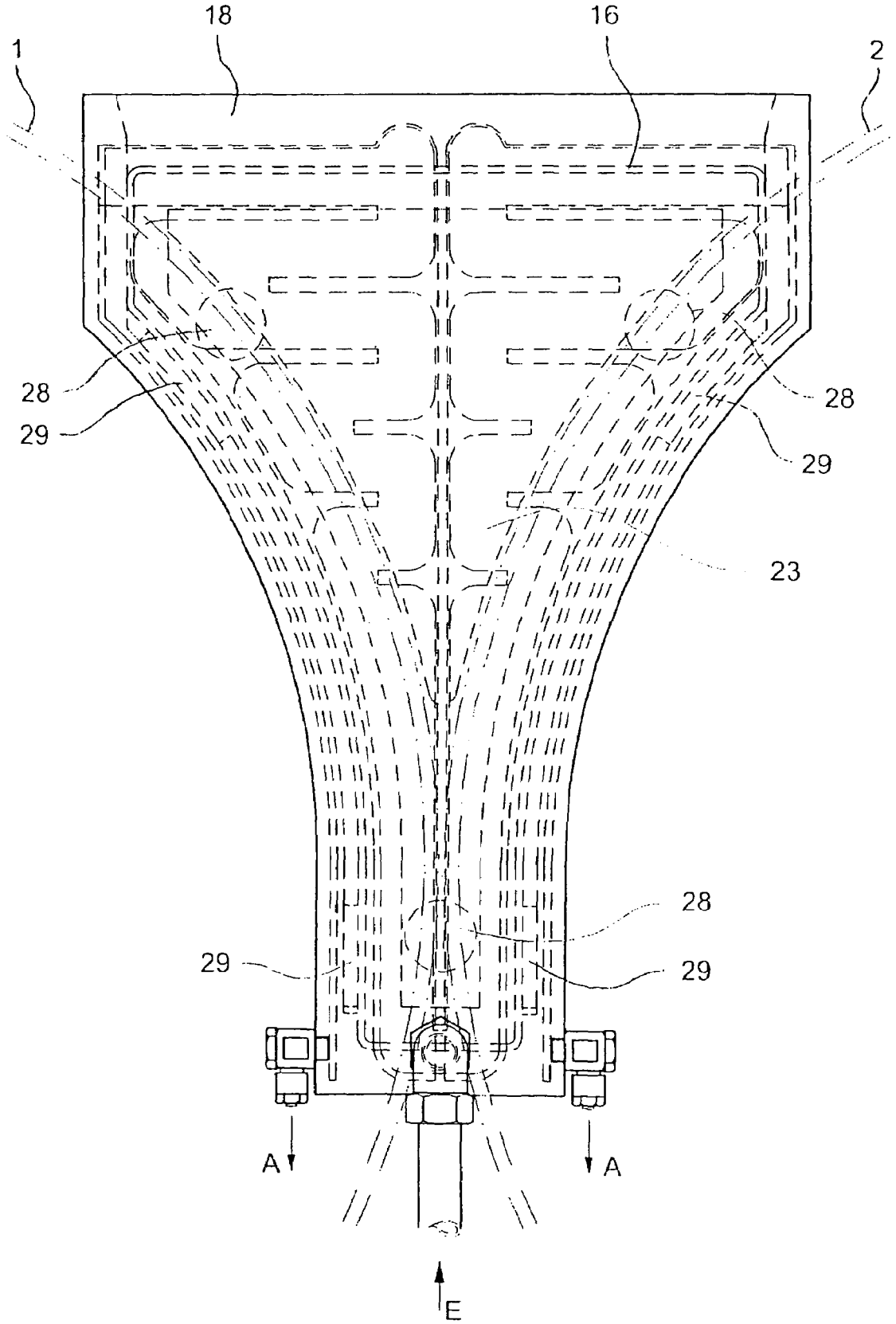
FIG. 2 a cross-sectional view along line II-II in FIG. 1.

FIGS. 1 and 2 show a lateral seal 10 for a strip casting machine and which is provided for a lateral sealing of a casting gap formed between two casting rolls. Two lateral seals 10 (also called narrow side parts), which are arranged on both ends surfaces of the casting rolls, limit the casting gap in its length. The casting rolls are shown with dash-dot lines in FIG. 2 and are designated with reference numerals 1 and 2.

The lateral seal 10 includes, as shown in FIG. 1, a sealing plate 11 arranged in a retaining frame 12 that is operationally connected with a placing device 13. The placing device 13 displaces the retaining frame 12, together with the sealing plate 11, in the longitudinal direction of the casting rolls 1, 2, whereby the sealing side 11*a* of the sealing plate 11 is placed or pressed against the end surfaces of the casting rolls 1, 2.

The placing device is per se known; e.g., a similar placing device is described in detail in the already mentioned WO-A-01/23122. Therefore, below, only essential elements of the placing device 13 would be described, whereas for details of the construction, reference is made to the previously mentioned publication.

The lateral seals 10 are displaced sidewise to and away from the casting rolls with a manipulator, not shown in the drawings. The placing device 13 includes, as shown in FIG. 1, a connection plate 50 which is connected in a manner not shown with a carrier element of the manipulator or is floatingly supported thereon. The retaining frame 12, in which the sealing plate 11 is received, is supported by hinge connection means, which is formed by an approximately horizontal hinge lever 51 and a vertical lever 52, on the connection plate 50. The hinge levers 51, 52 are spherically supported with one of their ends on the retaining frame 12 and with another of their ends on the connection plate 50. With elastic connection means, e.g., an adjustable tension spring 53, the retaining frame 12 is permanently pressed against pistons of three adjustment cylinders 55 which apply a controlled pressure through the retaining frame 12 to the sealing plate 11 in a manner of a three-point support. The adjustment cylinders 55 are activated after the lateral seals are brought into a position laterally of the casting rolls 1 and 2 and are centered.

The sealing plate 11 is located in a containment 16 of the retaining frame 12 and is supported on a steel support 17 of the retaining frame 12 that is secured thereto, e.g., welded thereto. The steel support 17 is connected preferably, welded, on one hand, to a rear frame part 18 and, on the other hand, to the containment 16, surrounding it. Both the rear frame part 18 and the side part 20 of the retaining frame 12 are provided with cooling channels 22, 23 for a cooling medium, preferably, cooling water. The feeding of the cooling water is shown in FIGS. 1 and 2 with arrow E, the discharge of the cooling water is shown in FIG. 2 with arrow A.

The sealing plate 11 is formed, preferably, of a inexpensive material that can be a graphite-containing carbon material or a mixture of $SiO_2$, $Al_2O_3$, zirconium oxide, graphite, similar to that the pouring spout are formed of. The sealing side 11*a* is coated with a material having good sliding and abrasive characteristics such as, e.g., boron nitride, SiAlON or abradables used as a sealing material in gas turbine. The coating is effected by application. The thickness of the layer amounts to from 0.1 to 2 mm. The sealing side 11*a* is coated with the same material over its entire surface. However, a different coating can be provided in the wettable region, e.g., having a low wetability with good isolation properties and wear characteristics.

The sealing plate 11 is supported with its surface remote from the sealing side 11*a* on three hard supports 28 and is positioned with a retaining member 29 provided on its circumference (such an attachment provides for an easy insertion and withdrawal of the sealing plate 11 in and out respectively, the retaining frame 12, i.e., a rapid exchange of the sealing plate 11). Between the sealing plate 11 and the containment 16, there is provided an isolation 30. As shown in FIG. 2, the hard supports 28 are associated with corner regions of the essentially triangular sealing plate 11. The adjustment cylinders 55 are likewise uniformly distributed.

The above-mentioned adjustment mechanism, which provides for a three-dimensional displacement of the side seal 10 upon placement or pressing of the respective sealing plate 11, provides for a very precise placement against end surfaces of the casting rolls 1, 2 even in heated operational condition, whereby the wear becomes as small as possible.

In order to be able to reduce this wear even further, it is proposed, according to the invention, to not retain constant the placement pressure during the following casting operation after grinding, during casting, of the sealing plate 11 which takes place as a result of the sealing plate 11 being pressed with a predetermined force against the end surfaces of the casting rolls 1, 2, i.e., the sealing plates 11 are not continuously placed but the placement is carried out with an intermittent process, also known as a so-called "stop-and-go" process, in repeatable intermittent steps, whereas for a predetermined duration, a holding time, the position of the sealing plates is kept unchanged before again the placement with a predetermined force for a predetermined time takes place. Both the placement force and the holding time can be varied. Those are adapted to the sealing behavior of the sealing plates 11.

During the casting phase, the sealing plates 11 firstly are pressed, for a relatively short time, against the end surfaces of the casting rolls 1, 2 and then, with the release of the press-on force, are held in a position before the intermittent placement of the sealing plates is undertaken.

The time for retaining the position, the holding time, can be much greater than the time of placement with a predetermined force and actually after 5 revolutions, whereby this can take place also after 500 revolutions. The length of the placement time depends on the diameter of the casting rolls, on the material of the casting rolls, the value of the application or press-on force, speed, steel quality, the material of the sealing plates, and/or other factors. Roughly, one considers a placement time from 1 to 30 sec. The applied pressure, as a rule, amounts to from 0.05 to 1.0 $N/mm^2$.

It is particularly advantageous when the lateral seals 10 are displaced or pivoted in a vertical and/or horizontal direction before a respective new placement in order to prevent or to reduce a non-uniform wear.

A monitoring and control system controls, in predetermined intervals, the placement of the sealing plates 11 with a predetermined force.

With the inventive method of operating a strip casting machine and which is characterized by long holding periods between separate placements, the wear of the sealing plates and the end sides of the casting rolls is noticeably reduced. A longer operating periods, which are results of the reduced wear, lead to noticeably reduced costs for the sealing plates per ton of steel, to longer casting sequences and to a higher output, whereby the economy of the process is substantially improved.

The invention claimed is:

1. A method of operating a strip casting machine for producing a metal strip, the method including the steps of:

continuously pouring of a metal melt between two, casting gap-forming, casting rolls (1, 2);

providing lateral seals (10) for forming a lateral limitation of a casting gap;

providing sealing plates (11) on the lateral seals (10); and moving the sealing plates (11) to be placed or pressed against end surfaces of the casting rolls (1, 2) with a predetermined placement or press-on force;

wherein the sealing plates (11) are placed in repeatable intermittent steps, wherein in a go-step, the sealing plates (11) are placed against the end surfaces of the casting rolls (1, 2) with a predetermined force and time, and are held in the stop position for a predetermined holding time significantly longer than the placement time.

2. A method according to claim 1, wherein a magnitude value of the predetermined placement or press-on force of the sealing plates (11) against the end surfaces of the casting rolls (1, 2) is adjustable.

3. A method according to claim 1, wherein the holding time of the sealing plates (11) in the placement position is varied.

4. A method according to claim 1, wherein the placement force and the placement time is adapted to a sealing behavior of the sealing plates (11) during a casting time.

5. A method according to claim 1, wherein in the placement phase, the sealing plates, for a relatively short time, are pressed against the end surfaces of the casting rolls (1, 2) and are subsequently released from the press-on force and are held in a position before the intermittent placement is carried out.

6. A method according to claim 1, wherein the holding time is double the placement time.

7. A method according to claim 1, wherein the holding time exceeds 300 times the maximum placement time.

8. A method according to claim 1, wherein a length of the placement time is adjustable based on predetermined factors selected from the group consisting of a diameter of the casting rolls (1, 2), a material composition of the end surfaces of the casting rolls, a value of the pressed-on or placement force of the sealing plates (11), a speed of the sealing plates (11), a steel quality of the material composition of the sealing plates (11), and a material composition of the sealing plates (11).

9. A method according to claim 1, wherein the sealing plates-containing lateral seals (10) are displaced or pivoted in vertical and/or horizontal direction before respective placements.

10. A method according to claim 1, wherein the placement is effected with an application pressure between 0.5 and 1.0 $N/mm^2$.

11. A method of operating a strip casting machine for producing a metal strip, the method including the steps of:

continuously pouring of a metal melt between two, casting gap-forming, casting rolls (1, 2);

providing lateral seals (10) for forming a lateral limitation of a casting gap;

providing sealing plates (11) on the lateral seals (10); and moving the sealing plates (11) to be placed or pressed against end surfaces of the casting rolls (1, 2) with a predetermined placement or press-on force;

wherein the sealing plates (11) are placed in repeatable intermittent steps, wherein in a go-step, the sealing plates (11) are placed against the end surfaces of the casting rolls (1, 2) with a predetermined force and time, and are held in the stop position for a predetermined holding time; and wherein the length of the placement time amounts to from 1 to 30 sec.

12. A method according to claim 11, wherein a magnitude value of the predetermined placement or press-on force of the sealing plates (11) against the end surfaces of the casting rolls (1, 2) is adjustable.

13. A method according to claim 11, wherein the holding time of the sealing plates (11) in the placement position is varied.

14. A method according to claim 11, wherein the placement force and the placement time is adapted to a sealing behavior of the sealing plates (11) during a casting time.

15. A method according to claim 11, wherein in the placement phase, the sealing plates, for a relatively short time, are pressed against the end surfaces of the casting rolls (1, 2) and are subsequently released from the press-on force and are held in a position before the intermittent placement is carried out.

16. A method according to claim 11, wherein the holding time is double the placement time.

17. A method according to claim 11, wherein the holding time exceeds 300 times the maximum placement time.

18. A method according to claim 11, wherein a length of the placement time is adjustable based on predetermined factors selected from the group consisting of a diameter of the casting rolls (1, 2), a material composition of the end surfaces of the casting rolls, a value of the pressed-on or placement force of the sealing plates (11), a speed of the sealing plates (11), a steel quality of the material composition of the sealing plates (11), and a material composition of the sealing plates (11).

19. A method according to claim 11, wherein the sealing plates-containing lateral seals (10) are displaced or pivoted in vertical and/or horizontal direction before respective placements.

20. A method according to claim 11, wherein the placement is effected with an application pressure between 0.5 and 1.0 $N/mm^2$.

* * * * *